US007185720B1

(12) United States Patent
Menna

(10) Patent No.: US 7,185,720 B1
(45) Date of Patent: Mar. 6, 2007

(54) HOLE DIGGER

(76) Inventor: Thomas Menna, 859 Goucher St., Johnstown, PA (US) 15905

( * ) Notice: Subject to any disclaimer, the term of this patent is extended or adjusted under 35 U.S.C. 154(b) by 209 days.

(21) Appl. No.: 10/711,629

(22) Filed: Sep. 29, 2004

(51) Int. Cl.
*E21B 21/00* (2006.01)

(52) U.S. Cl. ..... 175/213; 175/424; 175/209

(58) Field of Classification Search ..... 175/84, 175/324, 20, 215, 217, 213, 424, 320; 166/311; 172/371, 22, 329; 294/50.7, 64.1
See application file for complete search history.

(56) References Cited

U.S. PATENT DOCUMENTS 2,802,689 A * 8/1957 Batstone ..... 294/50.7
3,103,982 A * 9/1963 Henderson ..... 175/403
3,638,741 A * 2/1972 Zizak ..... 175/215
5,535,836 A * 7/1996 Cagianut et al. ..... 175/213
5,826,668 A * 10/1998 Kosmalski ..... 172/19
6,231,270 B1 * 5/2001 Cacossa ..... 405/248

* cited by examiner

*Primary Examiner*—David Bagnell
*Assistant Examiner*—David Andrews
(74) *Attorney, Agent, or Firm*—John J. Elnitski, Jr.

(57) ABSTRACT

A hole digger for digging a hole in ground. The hole digger includes a handle end for manually turning the hole digger. The hole digger includes a support section extending from the handle end. The hole digger includes a digging end extending from the support section.

16 Claims, 5 Drawing Sheets

HOLE DIGGER

BACKGROUND

The present invention generally relates to hole diggers. More specifically, the present invention relates to a manually operated hole diggers for making post holes.

There are two main types of hole diggers for making post holes in the ground. The first is a powered type. The powered type are powered by a power source and usually have an auger type bit which rotates into the ground. The power type usually makes an easy task of drilling a hole and removes the dirt and rock from the hole. The powered type are usually expensive and require some sort of fossil fuel. The expense can be prohibitive due to the planned number of uses. The fossil fuel is hazardous and can be messy to use. Most manually operated hole diggers are of a two blade clamping style. There is a handle attached to each of the blades. The blades are pivotally connected together. The blades are driven into the ground by holding the handles parallel and striking the ground with the tips of the blades. The user then pulls the handles away from each other, which forces the blades to move towards each other. As the blades move towards each other, they collect dirt at a depth of however far the blades have impacted the ground. The user must hold the handles away from each other under tension in order not to release the ground collected between the blades. This type of hole digger is very inefficient and requires a great amount of energy expended by the user.

It is an object of the present invention to provide manually operated hole digger which reduces the effort of the user to make a hole.

SUMMARY OF THE INVENTION

A hole digger for digging a hole in ground. The hole digger includes a handle end for manually turning the hole digger. The hole digger includes a support section extending from the handle end. The hole digger includes a digging end extending from the support section.

DETAILED DESCRIPTION

Figure 1:
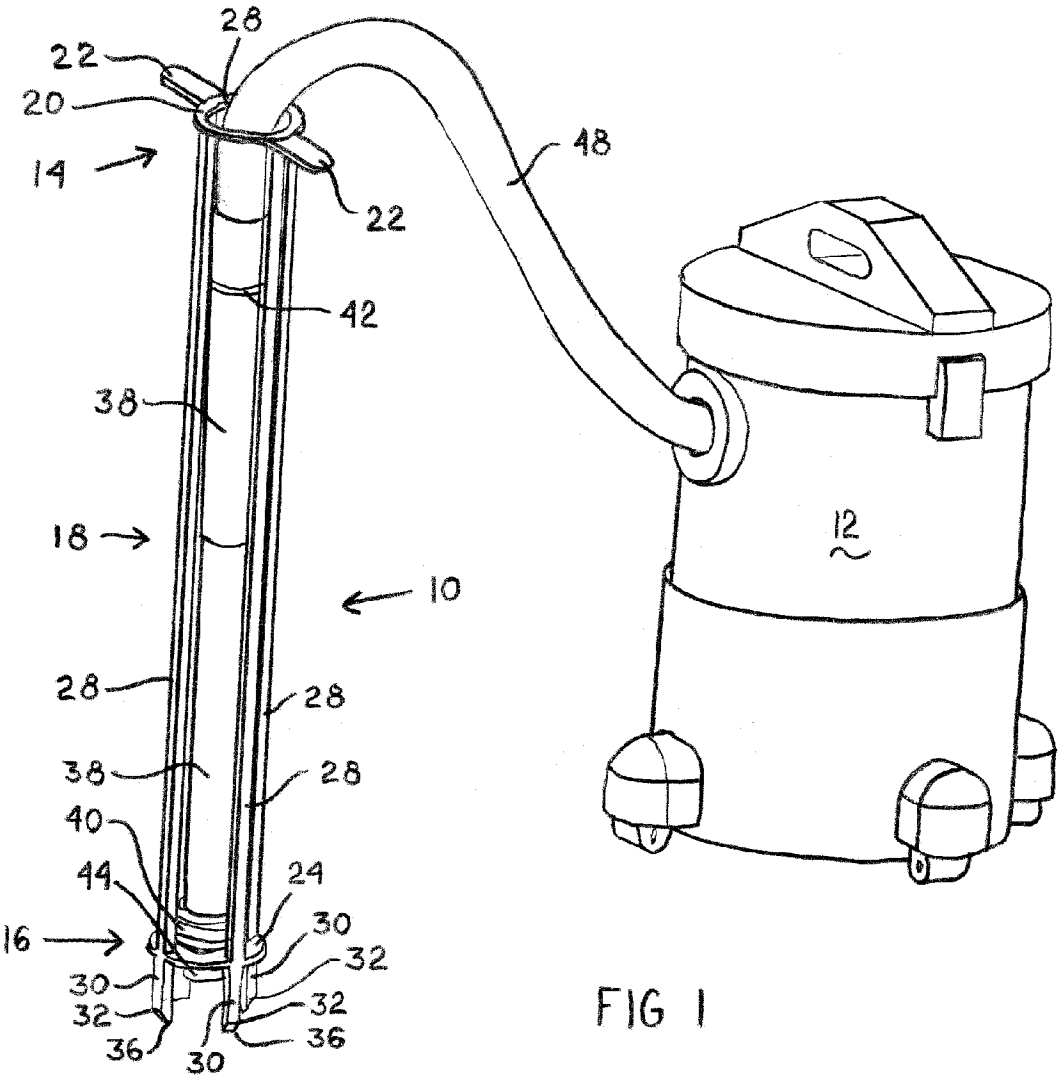
FIG. 1 is a perspective view of a hole digger according to the present invention.
Figure 2:
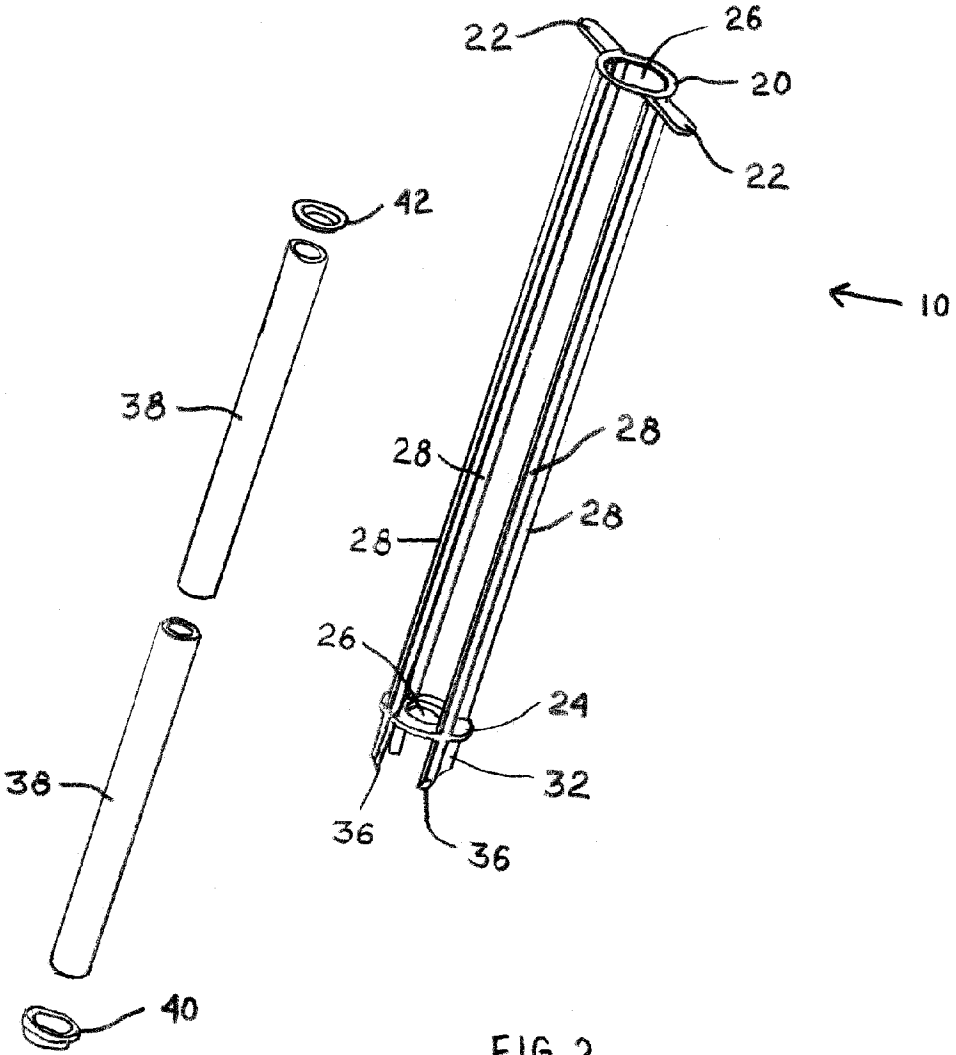
FIG. 2 is an exploded view of the hole digger according to the present invention.
Figure 3:
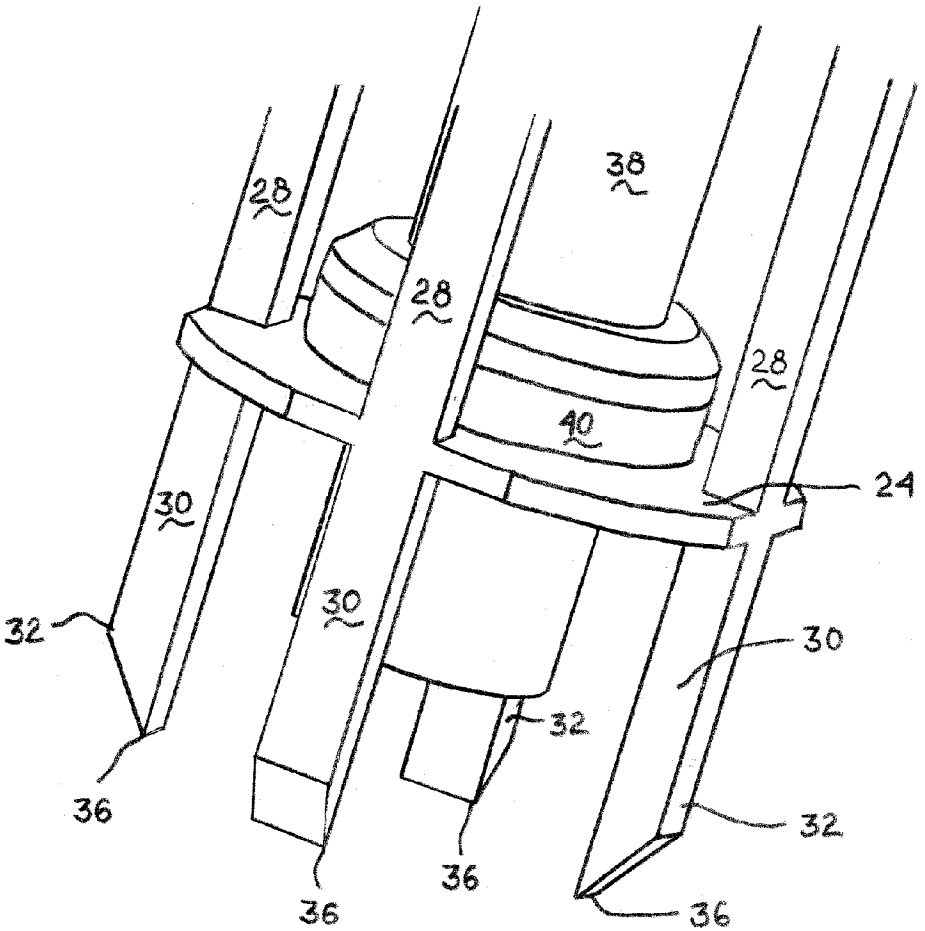
FIG. 3 is a perspective view of the sharpen prongs hole digger according to the present invention.

The present invention is a hole digger for manually digging a hole. The hole digger allows for attachment of a vacuum for removing the ground in the area where the hole is to be dug. FIG. 1 shows the hole digger 10 with a shop vacuum 12. The hole digger 10 includes a handle end 14, digging end 16 and support section 18 between the handle end 14 and digging end 16, as shown in FIGS. 1–2. The support section 18 is connected at the handle end 14 to a top ring 20, whereby two handles 22 extend from the top ring 20. The support section 18 is connected at the digging end 16 to a bottom ring 24. The top ring 20 and bottom ring 24 include an open center 26. The support section 18 is made up of four legs 28 connected between the top ring 20 and bottom ring 24. The four legs 28 form the outside of an open cylinder between the open centers 26 of the top ring 20 and bottom ring 24. The legs 28 should be made of a rigid material to provide support between the handles 22 and the digging end 16 when a user applies pressure to the handles 22.

FIGS. 1–4 show the digging end 16 of the hole digger 10. The digging end 14 includes four sharpen prongs 30 which form points along a circle. There can be more or less than four of the sharpen prongs 30 at the digging end 16. The sharpen prongs 30 of FIGS. 1–4 are shown as a continuation of the legs 28 of the support section 18, but could be separate from the legs 28. The sharpen prongs 30 have a bottom end 32 which contacts the ground 34 for digging. The bottom end 32 of the sharpen prong 30 is a sharp angle which comes to a point 36. The sharp angle runs from the point 36 and angles away from the circle formed by the sharpen prongs 30. Also shown in FIGS. 1–2 is vacuum extension tubing 38 used with shop vacuums. Two sections of extension tubing 38 are shown connected together within the open cylinder of the support section 18. A stop ring 40 and an alignment ring 42 are used with the extension tubing 38. The open center 26 of the top ring 20 is large enough to allow the extension tubing 38 with the stop ring 40 and alignment 42 installed to pass into the support section 18. The stop ring 40 is installed at a predetermined distance from the bottom end 32 of the prongs 30. The open center 26 of the bottom ring 24 is smaller than the stop ring 40. The stop ring 40 limits the distance that the bottom end 44 of the extension tubing 38 extends beyond the bottom ring 24. The alignment ring 42 is installed near the top of the extension tubing 38 to prevent the extension tubing 38 from rattling about the support section 18. FIG. 1 shows a hose 48 of the shop vacuum 12 attached to the top 46 of the extension tubing 38.

Figure 4:
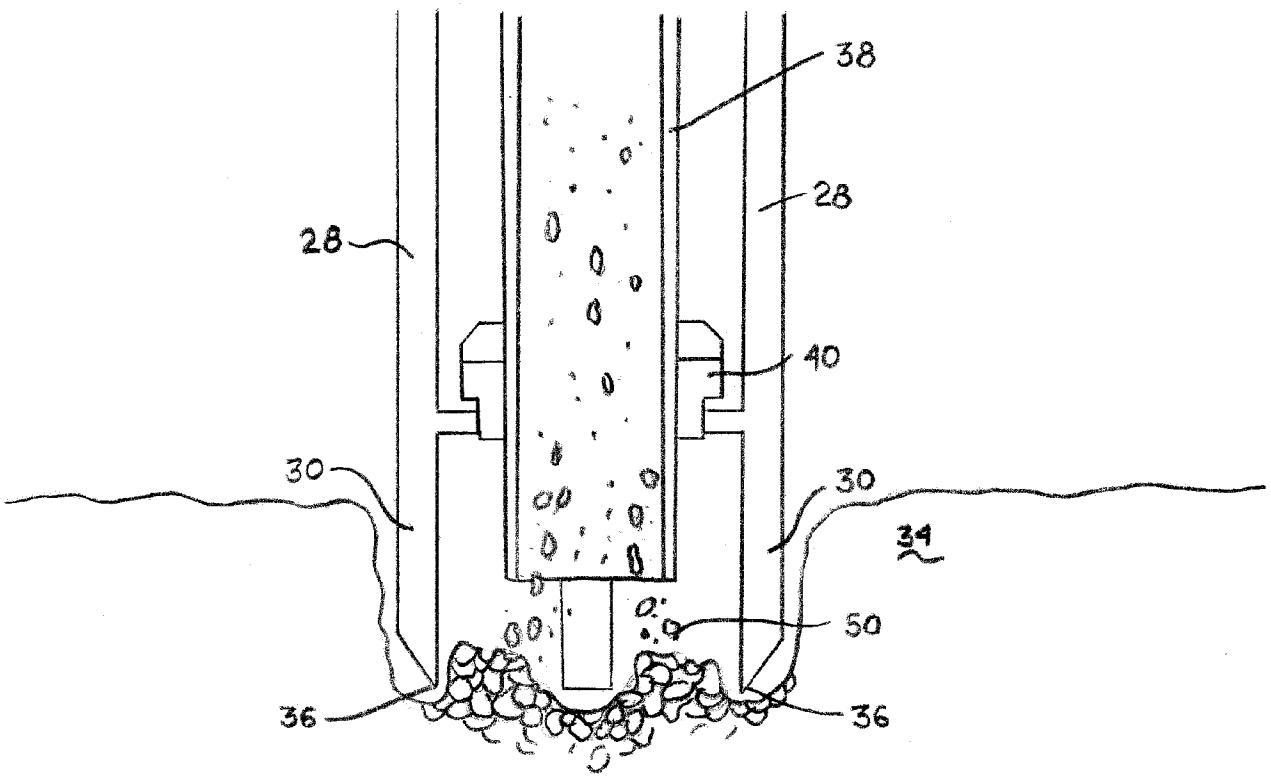
FIG. 4 is a cross-sectional view of a bottom hole digger according to the present invention.

The hole digger 10 is used as follows. The user presses the sharpen prongs 30 into the ground 34 at the point 36 on each of the sharpen prongs 30. The user presses the sharpen prongs 30 into the ground 34 by applying pressure at the handles 22. A hole is formed in the ground 34 by rotating and rocking at the handles 22 while applying pressure. The rotating and rocking of the handles 22 breaks up the ground 34. When breaking up the ground 34, the user has the shop vacuum 12 turned on. The suction from the shop vacuum 12 pulls the loosen ground 50 into the shop vacuum 12, as the sharpen prongs 30 break up the ground 34, as shown in FIG. 4.

Figure 5:
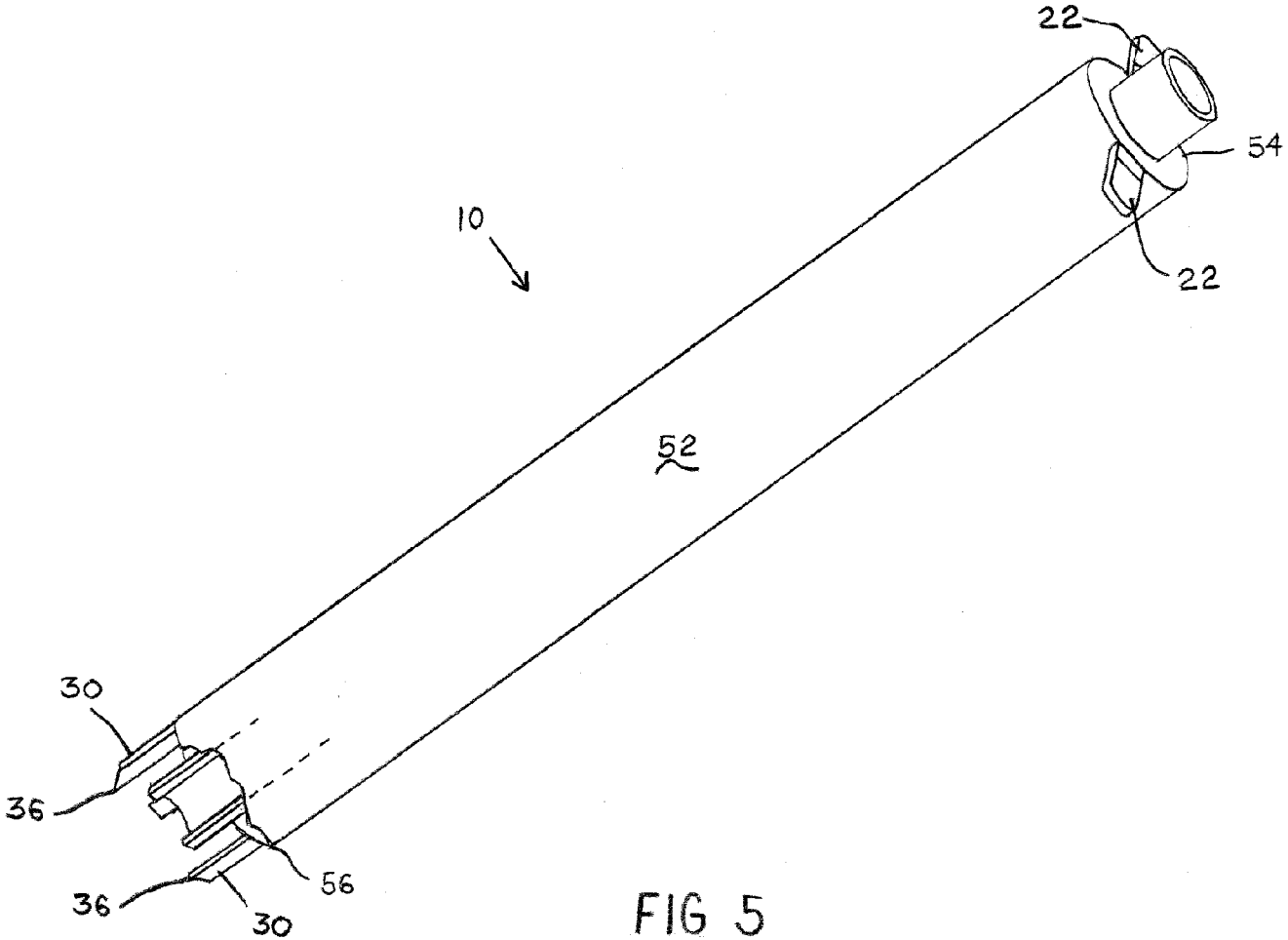
FIG. 5 is a perspective view of a hole digger according to the present invention.

FIG. 5 shows an alternative version of the hole digger 10. The legs 28, top ring 20 and bottom ring 24 are replaced by an open ended cylinder 52. The open ended cylinder 52 has a top 54 and a bottom 56. The open ended cylinder 52 is open thru the center from the top 54 and bottom 56. The top 54 of the open ended cylinder 52 connects to the hose of the shop vacuum. The open ended cylinder 52 not only replaces the legs 28, top ring 20 and bottom ring 24, but the extension tubing 38.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A hole digger, for digging a hole in ground, comprising:

a handle end for manually turning said hole digger;

a support section extending from said handle end;

a digging end extending from said support section;

a vacuum attachment point adapted for attaching a vacuum near said digging end to remove dirt during digging; and wherein said support section is open and adapted to receive an extension tube of a vacuum such that one end of the extension tube extends down into said digging end and the other end of the extension tube extends to said handle end to act as said vacuum attachment point.

2. The hole digger of claim 1, wherein said digging end includes at least two sharpen prongs.

3. The hole digger of claim 2, wherein said sharpened prongs each include a bottom end which contacts the ground for digging and wherein said bottom end is a sharp angle which comes to a point.

4. The hole digger of claim 3, wherein said sharp angle runs from the point and angles towards an outside of said hole digger.

5. The hole digger of claim 1, wherein said digging end includes a plurality of sharpened prongs which together form a circle.

6. The hole digger of claim 5, wherein said sharpened prongs each include a bottom end which contacts the ground for digging and wherein said bottom end is a sharp angle which comes to a point.

7. The hole digger of claim 6, wherein said sharp angle runs from the point and angles towards an outside of said hole digger.

8. The hole digger of claim 1, wherein said support section is connected at said handle end to a top ring; wherein said support section is connected at said digging end to a bottom ring; wherein said top and bottom rings include an open center; wherein said support section is made up of legs connected between said top and bottom rings, whereby said legs form an outside of a cylinder with an open center between said open centers of said top and bottom rings to receive the extension tube.

9. The hole digger of claim 8, wherein two handles extend from said top ring.

10. The hole digger of claim 8, wherein said digging end includes at least two sharpened prongs extending from said bottom ring.

11. The hole digger of claim 10, wherein said sharpened prongs each include a bottom end which contacts the ground for digging and wherein said bottom end is a sharp angle which comes to a point.

12. The hole digger of claim 8, further including a stop ring in said support section near said bottom ring that is adapted to receive one end of the extension tube to hold the extension tube in a position close to the ground and further including an alignment ring in said support section near said top ring that is adapted to prevent the extension tubing from rattling about said support section.

13. The hole digger of claim 1, further including a stop ring adapted to receive one end of the extension tube to hold the extension tube in a position close to the ground and further including an alignment ring adapted to prevent the extension tubing from rattling about said support section.

14. A hole digger, for digging a hole in ground, comprising:

a handle end for manually turning said hole digger;

a handle attached to said handle end to manually turn said hole digger;

a support section extending from said handle end;

a digging end extending from said support section;

a vacuum attachment point adapted for attaching a vacuum near said digging end to remove dirt during digging;

wherein said support section is an open ended cylinder having a top, a bottom and a center from said top to said bottom, said center of said support section being open from said top to said bottom of said support section, said top of said open ended cylinder being the vacuum attachment point adapted to connect the vacuum; and wherein said digging end includes at least two sharpened prongs extending from said digging end to dig and loosen dirt by turning said handle.

15. The hole digger of claim 14, wherein said sharpened prongs each include a bottom end which contacts the ground for digging and wherein said bottom end is a sharp angle which comes to a point.

16. The hole digger of claim 15, wherein said sharp angle runs from the point and angles towards an outside of said hole digger.

* * * * *